US010025334B1

(12) United States Patent
Derman

(10) Patent No.: US 10,025,334 B1
(45) Date of Patent: Jul. 17, 2018

(54) REDUCTION OF OUTPUT UNDERSHOOT IN LOW-CURRENT VOLTAGE REGULATORS

(71) Applicant: Nuvoton Technology Corporation, Hsin-chu (TW)

(72) Inventor: Itai Derman, Haifa (IL)

(73) Assignee: NUVOTON TECHNOLOGY CORPORATION, Hsin-chu (TW)

( * ) Notice: Subject to any disclaimer, the term of this patent is extended or adjusted under 35 U.S.C. 154(b) by 0 days.

(21) Appl. No.: 15/393,289

(22) Filed: Dec. 29, 2016

(51) Int. Cl.
*G05F 1/575* (2006.01)
*G05F 1/56* (2006.01)

(52) U.S. Cl.
CPC ..... *G05F 1/575* (2013.01); *G05F 1/56* (2013.01)

(58) Field of Classification Search
CPC . G05F 1/46; G05F 1/461; G05F 1/462; G05F 1/468; G05F 1/56; G05F 1/563; G05F 1/565; G05F 1/575; G05F 1/59
See application file for complete search history.

(56) References Cited

U.S. PATENT DOCUMENTS

| | | | | |
|---|---|---|---|---|
| 5,672,959 | A | 9/1997 | Der | |
| 7,450,916 | B1 | 11/2008 | Hietala et al. | |
| 7,498,780 | B2 | 3/2009 | Chen et al. | |
| 8,193,798 | B1 | 6/2012 | Pace et al. | |
| 8,258,875 | B1 | 9/2012 | Smith et al. | |
| 8,436,595 | B2 * | 5/2013 | Simmons | G05F 1/575 323/273 |
| 8,502,513 | B2 * | 8/2013 | Imura | G05F 1/56 323/282 |
| 2005/0040796 | A1 | 2/2005 | Sutardja | |
| 2005/0189931 | A1 | 9/2005 | Ishino | |
| 2006/0038710 | A1 | 2/2006 | Staszewski et al. | |
| 2007/0152742 | A1 | 7/2007 | Rincon-Mora et al. | |
| 2008/0224680 | A1 | 9/2008 | Suzuki | |
| 2009/0085535 | A1 | 4/2009 | Wei | |
| 2009/0085610 | A1 | 4/2009 | Westwick | |
| 2009/0085619 | A1 | 4/2009 | Westwick et al. | |
| 2009/0085651 | A1 | 4/2009 | Liu et al. | |
| 2009/0085684 | A1 | 4/2009 | Guo et al. | |
| 2009/0085685 | A1 | 4/2009 | Guo et al. | |
| 2009/0086517 | A1 | 4/2009 | Wei et al. | |
| 2009/0089599 | A1 | 4/2009 | Westwick et al. | |
| 2009/0278609 | A1 | 11/2009 | Srinivasan et al. | |
| 2009/0315484 | A1 | 12/2009 | Cegnar et al. | |
| 2010/0166228 | A1 | 7/2010 | Steele et al. | |
| 2010/0277148 | A1 | 11/2010 | Zhao et al. | |
| 2011/0022859 | A1 | 1/2011 | More et al. | |
| 2011/0298280 | A1 | 12/2011 | Homol et al. | |
| 2011/0309760 | A1 | 12/2011 | Beland et al. | |
| 2012/0069606 | A1 | 3/2012 | Sagneri et al. | |

(Continued)

FOREIGN PATENT DOCUMENTS

| | | | |
|---|---|---|---|
| EP | 2560063 | A1 | 2/2013 |
| WO | 0135640 | A2 | 5/2001 |
| WO | 15139053 | A1 | 9/2015 |

*Primary Examiner* — Matthew Nguyen
(74) *Attorney, Agent, or Firm* — D. Kligler IP Services Ltd.

(57) ABSTRACT

An electronic circuit includes a voltage regulator and an undershoot reduction circuit. The undershoot reduction circuit is configured to receive an indication of an event that potentially causes an undershoot in an output of the voltage regulator, and, in response to the indication, to generate and couple to the output of the voltage regulator a pulse that reduces the undershoot.

16 Claims, 2 Drawing Sheets

(56) References Cited

U.S. PATENT DOCUMENTS

| | | | | |
|---|---|---|---|---|
| 2012/0229202 | A1 | 9/2012 | Nikolov et al. | |
| 2013/0094414 | A1 | 4/2013 | Park et al. | |
| 2014/0239929 | A1 | 8/2014 | Fiocchi et al. | |
| 2014/0253069 | A1* | 9/2014 | Utsunomiya | G05F 1/46 323/273 |
| 2014/0253076 | A1* | 9/2014 | Utsunomiya | H02M 3/158 323/282 |
| 2014/0354249 | A1* | 12/2014 | Kurozo | G05F 1/575 323/271 |
| 2015/0168971 | A1* | 6/2015 | Tomioka | G05F 1/565 323/275 |
| 2015/0188402 | A1 | 7/2015 | Panigrahi | |
| 2015/0286231 | A1 | 10/2015 | Gerber et al. | |

* cited by examiner

REDUCTION OF OUTPUT UNDERSHOOT IN LOW-CURRENT VOLTAGE REGULATORS

FIELD OF THE INVENTION

The present invention relates generally to power supply circuitry, and particularly to methods and systems for reducing output undershoot transients in voltage regulators.

BACKGROUND OF THE INVENTION

Various power supply configurations are known in the art. Some power supply designs are based on Low Drop-Out (LDO) voltage regulators. For example, U.S. Pat. No. 5,672,959, whose disclosure is incorporated herein by reference, describes a low drop-out regulator circuit having first and second feedback loops. A first local feedback loop is a high-speed, high-bandwidth loop that actively rejects noise from the input source to the regulator. A second feedback loop, having lower speed and a correspondingly lower bandwidth than the first feedback loop, regulates the output voltage.

U.S. Patent Application Publication 2005/0189931, whose disclosure is incorporated herein by reference, describes a power supply unit comprising a series regulator and a switching DC-DC converter controlled by a PWM signal and connected in parallel with the series regulator, which are switchable, enabled by a mode instruction signal depending on the magnitude of a load current.

U.S. Patent Application Publication 2007/0152742, whose disclosure is incorporated herein by reference, describes a low dropout voltage regulator comprising a supply input terminal for connecting a supply voltage and an output terminal for providing a regulated output voltage, a reference voltage source, and an output voltage monitor. An error amplifier has an output supplying an error signal in response to deviations of the regulated output voltage from a desired target output voltage value at the output terminal. A power output FET has a drain-source channel connected between the supply input terminal and the output terminal of the voltage regulator. A gate terminal of the power output FET is controlled by the error amplifier via a driver FET such that deviations of the regulated output voltage are minimized.

U.S. Patent Application Publication 2008/0224680, whose disclosure is incorporated herein by reference, describes a voltage regulator. To enhance the safety of the voltage regulator, a control circuit controls a PMOS to be turned on and operates so as to increase the output voltage when the output voltage drops transiently due to rapid fluctuations of a load connected to an output terminal and predetermined conditions are not satisfied, and does not perform an operation for increasing the output voltage and causes the protection circuit to protect the voltage regulator when the output voltage drops transiently and the predetermined conditions are satisfied.

U.S. Patent Application Publication 2010/0277148, whose disclosure is incorporated herein by reference, describes a voltage regulator having one or more discharger circuits that compensate for low on-chip output capacitance and a slow loop response time. In one embodiment, the voltage regulator includes an output transistor coupled to an output voltage line, an output voltage sensing arrangement coupled to the output voltage line for producing an output feedback voltage, and an error amplifier coupled to the output feedback voltage, the output transistor, and a reference voltage for applying feedback control to the output transistor. A first discharger circuit is coupled to the output voltage line and to a reference potential, the first discharger circuit being triggered by a steep-rise overvoltage condition. In another embodiment, a combination of fast and slow discharger circuits is used to improve the load step response.

U.S. Patent Application Publication 2014/0239929, whose disclosure is incorporated herein by reference, describes a low dropout regulator comprising an output transistor with a controlled section coupled between a first supply terminal and an output terminal, and a differential amplifier that comprises a feedback input coupled to the output terminal, a reference input for receiving a reference voltage, an output connected to a control terminal of the output transistor, and at least one pair of input transistors. The input transistors of each pair are commonly connected to a tail current source of the respective pair. A control terminal of a respective first transistor of each pair is connected to the reference input. A control terminal of a respective second transistor of each pair is connected to the feedback input. A first capacitive element is coupled between the output terminal and the common connection of the input transistors of one pair with their respective tail current source. A second capacitive element is coupled between a second supply terminal and the common connection of the input transistors of one pair with their respective tail current source.

U.S. Pat. No. 7,498,780, whose disclosure is incorporated herein by reference, describes a linear voltage regulating circuit with undershoot minimization. The circuit includes a voltage regulator, a converting circuit, a capacitive device, a first current mirror module, and a second current mirror module. The voltage regulator has a first output producing the regulated output voltage and a second output producing a pass voltage. The converting circuit converts the pass voltage into a first current and a second current passing through a first converting node and a second converting node respectively, where the first current charges/discharges the capacitive device. The first current mirror module has a first current mirror path coupled to the first converting node and a second current mirror path coupled to the second converting node. The second current mirror module has a first current mirror path coupled to the second converting node and a second current mirror path coupled to the first output.

SUMMARY OF THE INVENTION

An embodiment of the present invention that is described herein provides an electronic circuit including a voltage regulator and an undershoot reduction circuit. The undershoot reduction circuit is configured to receive an indication of an event that potentially causes an undershoot in an output of the voltage regulator, and, in response to the indication, to generate and couple to the output of the voltage regulator a pulse that reduces the undershoot.

In some embodiments, the undershoot reduction circuit includes a pulse generator that is triggered by the indication, and a current source that is connected to the output of the voltage regulator and is controlled by the pulse generator. In an embodiment, the current source includes a resistance connected in series with a transistor whose gate is controlled by the pulse generator. In a disclosed embodiment, the undershoot reduction circuit is configured to reduce the undershoot without feedback from the output of the voltage regulator. In an example embodiment, the event includes a transition from a high voltage state to a low voltage state. In an embodiment, the pulse has a fixed time duration.

There is additionally provided, in accordance with an embodiment of the present invention, an Integrated Circuit (IC) including a voltage regulator, a control circuit and an undershoot reduction circuit. The control circuit is configured to generate an indication of an event that potentially causes an undershoot in an output of the voltage regulator. The undershoot reduction circuit is configured, in response to the indication, to generate and couple to the output of the voltage regulator a pulse that reduces the undershoot.

There is further provided, in accordance with an embodiment of the present invention, a method for voltage regulation, including receiving an indication of an event that potentially causes an undershoot in an output of a voltage regulator. In response to the indication, a pulse that reduces the undershoot is generated and coupled to the output of the voltage regulator.

The present invention will be more fully understood from the following detailed description of the embodiments thereof, taken together with the drawings in which:

DETAILED DESCRIPTION OF EMBODIMENTS

Overview

Figure 1:
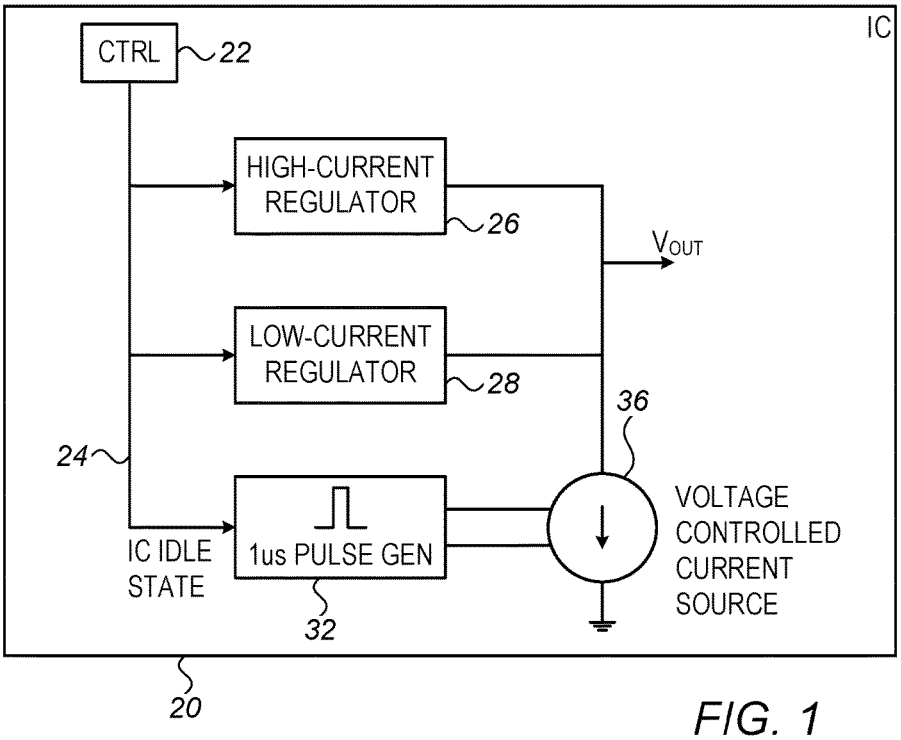
FIG. 1 is a block diagram that schematically illustrates voltage regulation circuitry in an Integrated Circuit (IC), in accordance with an embodiment of the present invention.

Embodiments of the present invention that are described herein provide methods and devices for reducing undershoot transients at the output of a voltage regulator. An undershoot transient may occur, for example, following a transition of the regulator from a certain output voltage state to a lower output voltage state, especially when the regulator has relatively narrow loop bandwidth. Occurrence of such undershoot may be Process, Voltage and/or Temperature (PVT) dependent.

In some embodiments, an undershoot reduction circuit is coupled to the output of the voltage regulator. The undershoot reduction circuit receives an indication of an event that may potentially cause undershoot in the output of the voltage regulator. In response to the indication, the undershoot reduction circuit generates at the output of the voltage regulator a short current pulse that compensates for the undershoot.

In an embodiment, the undershoot reduction circuit comprises a pulse generator that drives a voltage-controlled current source. In response to the indication, the pulse generator generates a pulse shorter than the expected undershoot duration, e.g., a 1 μS voltage pulse, which causes the current source to apply a corresponding current pulse at the output of the voltage regulator.

In a typical implementation, the current pulse causes the current in the output stage of the voltage regulator to increase rather than drop to zero. As a result, when the current pulse ends, the output stage current remains positive, thereby achieving a high effective transconductance ($g_m$) and bandwidth in the regulator output stage. The regulator is therefore able to respond rapidly to the undershoot, and substantially reduce or prevent it.

In an example use-case the voltage regulator is a compound Low Drop-Out (LDO) regulator in an Integrated Circuit (IC). The LDO regulator comprises a High-Current (HC) Voltage Regulator (VR) for the functional state of the IC and a Low-Current (LC) VR for the IC idle state. When the IC transitions to the idle state, a control circuit in the IC disables the HC VR and enables the LC VR, which starts operating at a high-voltage state and shortly thereafter switches to a lower-voltage state. This switchover typically causes undershoot in the voltage regulator output. In an embodiment, the undershoot reduction circuit receives from the control circuit an indication of the transition to the idle state, and an additional indication of the reduction in voltage level, and generates the compensation pulse on time so as to coincide with the undershoot.

The disclosed undershoot reduction technique is highly effective and simple to implement. Since the pulse generated by the undershoot reduction circuit is short, e.g., 1 μS, and is generated very rarely, its effect on power consumption and efficiency is negligible. Moreover, since the disclosed circuit uses an indication of undershoot, rather than relying on feedback from the output of the voltage regulator, it has virtually zero response time.

System and Circuit Description

FIG. 1 is a block diagram that schematically illustrates voltage regulator circuitry in an Integrated Circuit (IC) 20, in accordance with an embodiment of the present invention. In the present example, although not necessarily, IC 20 is an Embedded Controller (EC) chip in a computer. IC 20 supports various operational states, including for example a functional state and an idle state. The IC comprises control circuitry 22 that, among other functions, selects the appropriate operational state and configures the IC power-supply circuitry accordingly. In an embodiment, control circuitry 22 generates a control signal 24 that indicates transitioning into (and possibly also out of) the idle state, and corresponding voltage level changes.

In the present example, the power-supply circuitry comprises a High-Current (HC) Voltage Regulator (VR) 26 for supplying a certain voltage while the IC is in functional state, and a Low-Current (LC) Voltage Regulator (VR) 28 for supplying different voltages while the IC is in idle state. Regulators 26 and 28 typically comprise Low Drop-Out (LDO) regulators.

Regulators 26 and 28 are enabled and disabled based on control signal 24 received from control circuitry 22. High-current regulator 26 is enabled when the IC is in functional state and disabled when the IC is in idle state. Low-current regulator 28 is operated in the opposite fashion, i.e., enabled when the IC is in idle state and disabled when the IC is in functional state.

In the present example, when voltage regulator 28 is enabled (upon the IC entering the idle state), it initially enters a high-voltage state in which it supplies a relatively high voltage of 1.25V. Shortly thereafter, regulator 28 switches to a low-voltage state in which it supplies a lower voltage of 1.15V. The output voltage is denoted $V_{OUT}$ in the figure.

In practice, the state transition of LC VR 28 from 1.25 v to 1.15 v causes $V_{OUT}$ to reduce, and can cause the output transistor (transistor 48 discussed below) to turn off (zero current) which in turn causes $V_{OUT}$ to drop (due to regulator load) considerably below 1.15 v. The undershoot lasts until regulator 28 has sufficient time to respond to the output voltage drop and regulate the output voltage back to the desired 1.15V value. Undershoot of this sort may cause logic errors, and is therefore highly undesirable.

In some embodiments, IC 20 comprises an undershoot reduction circuit that compensates for the undershoot that potentially occurs in the output voltage when regulator 28 is enabled. In the example of FIG. 1, the undershoot reduction circuit comprises a pulse generator 32 and a voltage-controlled current source 36.

Pulse generator 32 is triggered by control signal 24, and generates a short voltage pulse in response to an indication that the IC is transitioning to a lower voltage state while in the idle state. The pulse duration (1 μS in the present example) is typically set to compensate for the expected duration of the undershoot transient.

Typically, the pulse duration and timing are fixed relative to control signal 24, and are not adapted or controlled in any way as a function of the actual output of regulator 28. In this sense, the undershoot reduction circuit operates in "open loop." This open-loop operation enables the undershoot reduction circuit to achieve rapid response time. As a result, the compensating current pulse may coincide with the undershoot, without a delay that would inevitably occur in a closed-loop scheme.

Figure 2:
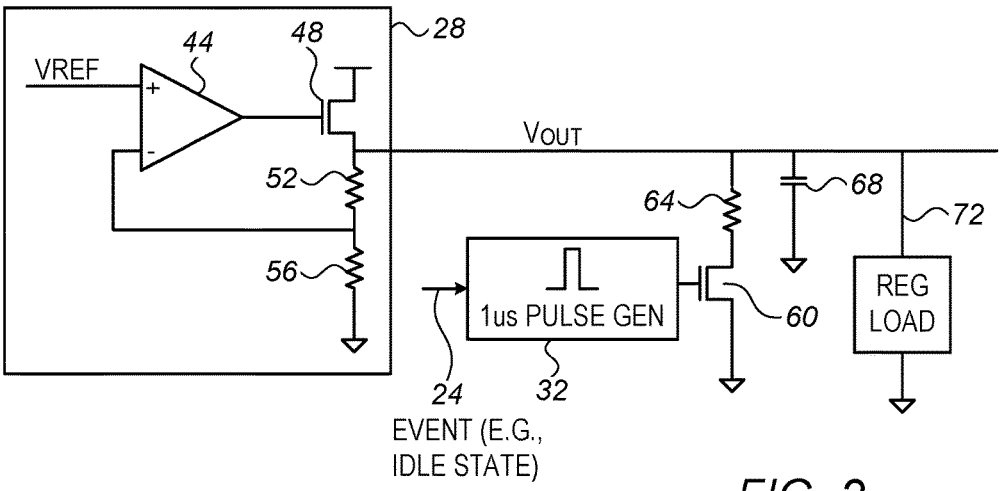
FIG. 2 is a circuit diagram that schematically illustrates a voltage regulator comprising undershoot reduction circuitry, in accordance with an embodiment of the present invention.

FIG. 2 is a circuit diagram that schematically illustrates voltage regulator 28 and the undershoot reduction circuit in greater detail, in accordance with an embodiment of the present invention. In the present example, regulator 28 comprises an amplifier 44 that is connected in a negative feedback loop configuration, and receives a reference voltage $V_{REF}$. The desired output voltage of the regulator, relative to $V_{REF}$, is set by a voltage divider comprising resistors 52 and 56.

The output stage of regulator 28 further comprises a transistor 48, in the present example a Metal Oxide Silicon Field-Effect Transistor (MOSFET). An output capacitor 68 is also considered part of regulator 28. A load 72 represents the load of the IC circuitry that is powered by $V_{OUT}$.

In some embodiments, following the switchover from the high-voltage state to the low-voltage state of regulator 28, the gate voltage of transistor 48 may drop considerably and switch transistor 48 into cutoff. When in cutoff, the drain-source current in transistor 48 can drop to zero, which breaks the VR feedback loop and causes undershoot on $V_{OUT}$.

In the embodiment of FIG. 2, the undershoot reduction circuit comprises pulse generator 32, which drives a voltage controlled current source. The current source comprises a transistor 60 and a resistor 64. The pulse generated by generator 32 is applied to the gate of transistor 60, thereby generating a current pulse at the regulator output ($V_{OUT}$). In the present example, transistor 60 comprises an N-type-channel Metal Oxide Semiconductor (NMOS) transistor. Alternatively, however, transistor 60 may comprise any other suitable type of transistor, e.g., a bipolar transistor or Junction FET (JFET).

In the present example, the pulse duration is approximately 1 μS and its magnitude is approximately 100 μA. These values are depicted by way of example, to match the characteristics of the undershoot transient in one example application. Different designs may require different current pulse magnitudes and durations, e.g., depending on load.

During the expected time duration of the undershoot transient, the additional current pulse causes the drain-source current in transistor 48 to be always positive and not drop to zero. As a result, the transconductance ($g_m$) and bandwidth of transistor 48 are increased. Therefore, the feedback loop of regulator 28 is kept electrically closed at all times, and is able to respond quickly to output reduction, and thus to minimize the undershoot in $V_{OUT}$ and retain it within the specified range.

The circuit configurations shown in FIGS. 1 and 2 are example configurations that are chosen for the sake of conceptual clarity. In alternative embodiments, any other suitable configuration can be used. For example, the undershoot reduction circuit may have any other suitable configuration. Additionally or alternatively, regulator 28, whose undershoot is reduced using the disclosed techniques, may comprise any other suitable type of voltage regulator.

Moreover, the disclosed techniques are in no way limited to regulators that provide low current during idle state. The regulator may be part of any other suitable electronic circuit or host system, and serve to provide any desired voltage for any other suitable purpose.

In some embodiments, IC 20 is fabricated using a conventional Complementary Metal Oxide Semiconductor (CMOS) process. In such embodiments, regulator 28 and the undershoot reduction circuit are fabricated as part of the IC fabrication using the same process. In other embodiments, regulator 28 and/or the undershoot reduction circuit may be fabricated in any other suitable way, e.g., using discrete components and/or programmable logic devices such as a Field-Programmable Gate Array (FPGA).

Simulated Performance

Figure 3:
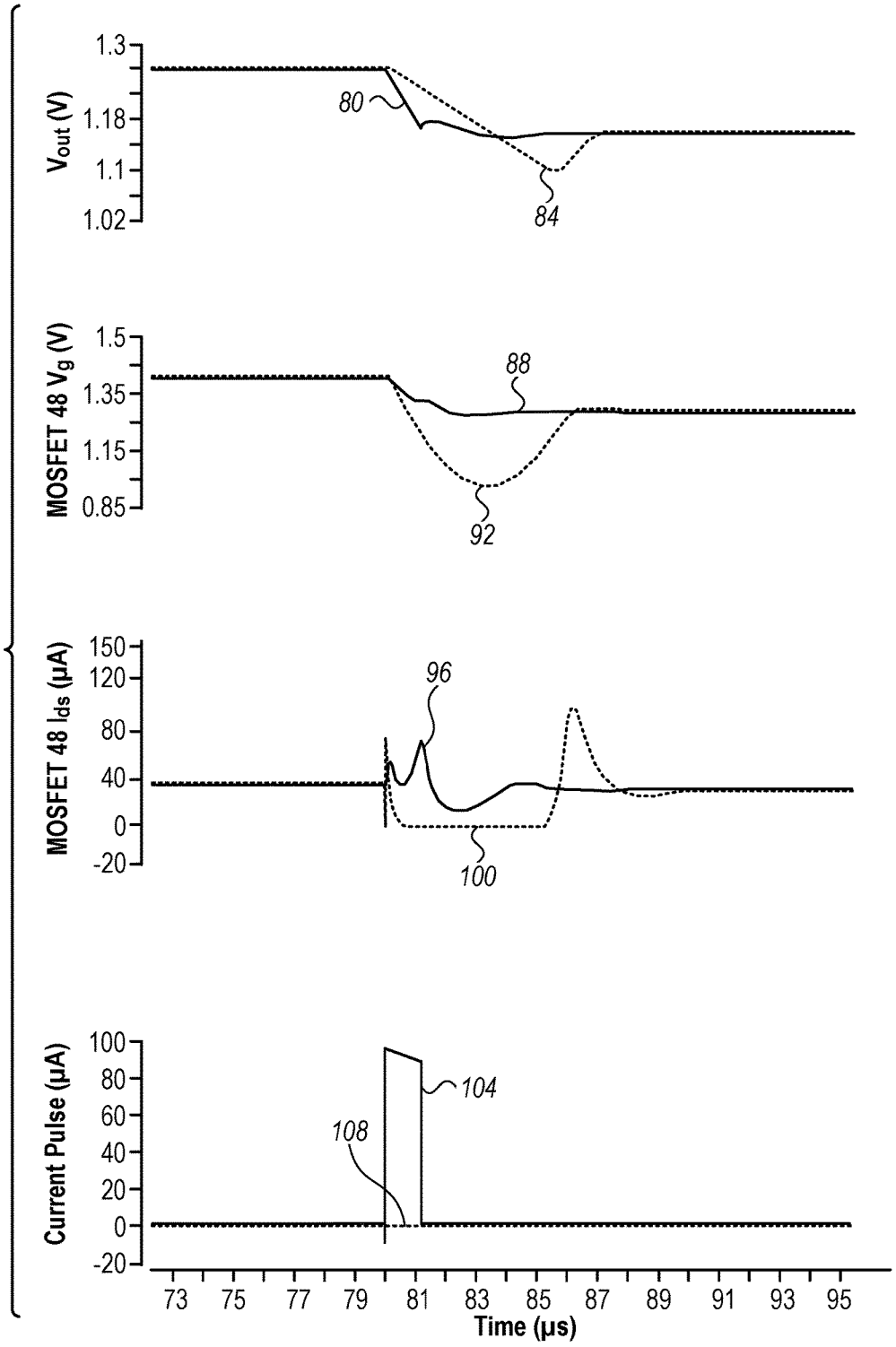
FIG. 3 is a graph showing simulated performance of a voltage regulator comprising undershoot reduction circuitry, in accordance with an embodiment of the present invention.

FIG. 3 is a graph showing simulated performance of the voltage regulator and undershoot reduction circuit of FIG. 2, in accordance with an embodiment of the present invention. In the figure, solid curves illustrate the performance of the disclosed technique. Dashed curves illustrate performance without the disclosed technique, for comparison. FIG. 3 illustrates the circuit behavior as a function of time, with and without the disclosed technique.

At the top of the figure, a curve 80 shows the output voltage $V_{OUT}$ when the compensation pulse is applied using the disclosed technique. A curve 84 shows $V_{OUT}$ when the disclosed technique is not applied, for comparison. In the present example, the regulator switchover from 1.25V to 1.15V occurs at approximately t=80 μS. As can be seen in the figure, without the disclosed technique (curve 84) the output voltage exhibits an undershoot transient. When using the disclosed technique (curve 80) the undershoot is eliminated and the transition from 1.25V to 1.15V is damped and smooth.

In the second graph in FIG. 4, curves 88 and 92 show the gate voltage ($V_g$) of transistor 48 with and without applying the disclosed technique, respectively. Without the disclosed technique, following the switchover from 1.25V to 1.15V the gate voltage drops considerably, causing transistor 48 to go into cutoff region.

In the third graph, curves 96 and 100 show the drain-source current ($I_{ds}$) through transistor 48 with and without applying the disclosed technique, respectively. As can be seen in the figure, without the disclosed technique the transistor current drops substantially to zero when transistor 48 is in cutoff region. The compensation pulse prevents this drop.

At the bottom of FIG. 3, curves 104 and 108 show the current through transistor 60 with and without compensation using the disclosed technique, respectively. Although the embodiments described herein mainly address implementation in an Embedded Controller (EC), the methods and systems described herein can also be used in other applications, such as in notebook and tablet computers, as well as mobile phones.

It will thus be appreciated that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. An electronic circuit, comprising:

a voltage regulator; and an undershoot reduction circuit, which is configured to:

receive an indication of an event that potentially causes an undershoot in an output of the voltage regulator; and in response to the indication, generate and add to the output of the voltage regulator a compensation pulse that compensates for the undershoot.

2. The electronic circuit according to claim 1, wherein the undershoot reduction circuit comprises a pulse generator that is triggered by the indication, and a current source that is connected to the output of the voltage regulator and is controlled by the pulse generator.

3. The electronic circuit according to claim 2, wherein the current source comprises a resistance connected in series with a transistor whose gate is controlled by the pulse generator.

4. The electronic circuit according to claim 1, wherein the undershoot reduction circuit is configured to reduce the undershoot without feedback from the output of the voltage regulator.

5. The electronic circuit according to claim 1, wherein the event comprises a transition from a high voltage state to a low voltage state.

6. The electronic circuit according to claim 1, wherein the compensation pulse has a fixed time duration.

7. The electronic circuit according to claim 1, wherein, by adding the compensation pulse to the output of the voltage regulator, the undershoot reduction circuit is configured to maintain an electrical current at an output stage of the voltage regulator above zero, thereby shortening a response time of the voltage regulator to the undershoot.

8. An Integrated Circuit (IC), comprising:

a voltage regulator;

a control circuit, configured to generate an indication of an event that potentially causes an undershoot in an output of the voltage regulator; and an undershoot reduction circuit that is configured, in response to the indication, to generate and add to the output of the voltage regulator a compensation pulse that compensates for the undershoot.

9. The IC according to claim 8, wherein the undershoot reduction circuit comprises a pulse generator that is triggered by the indication, and a current source that is connected to the output of the voltage regulator and is controlled by the pulse generator.

10. The IC according to claim 9, wherein the current source comprises a resistance connected in series with a transistor whose gate is controlled by the pulse generator.

11. The IC according to claim 8, wherein the undershoot reduction circuit is configured to reduce the undershoot without feedback from the output of the voltage regulator.

12. The IC according to claim 8, wherein the event indicated by the control circuit comprises a transition from a high voltage state to a low voltage state.

13. The IC according to claim 8, wherein the compensation pulse has a fixed time duration.

14. The IC according to claim 8, wherein, by adding the compensation pulse to the output of the voltage regulator, the undershoot reduction circuit is configured to maintain an electrical current at an output stage of the voltage regulator above zero, thereby shortening a response time of the voltage regulator to the undershoot.

15. A method for voltage regulation, comprising:

receiving an indication of an event that potentially causes an undershoot in an output of a voltage regulator; and in response to the indication, generating and adding to the output of the voltage regulator a compensation pulse that compensates for the undershoot.

16. The method according to claim 15, wherein adding the compensation pulse to the output of the voltage regulator comprises maintaining an electrical current at an output stage of the voltage regulator above zero, thereby shortening a response time of the voltage regulator to the undershoot.

* * * * *